US007065932B2

(12) United States Patent
Roesset et al.

(10) Patent No.: US 7,065,932 B2
(45) Date of Patent: Jun. 27, 2006

(54) TOP FLANGE STUD TO PLATE TIE

(75) Inventors: Charles Roesset, Brentwood, CA (US); Louay A. Shamroukh, Discovery Bay, CA (US)

(73) Assignee: Simpson Strong-Tie Company, Inc., Dublin, CA (US)

( * ) Notice: Subject to any disclaimer, the term of this patent is extended or adjusted under 35 U.S.C. 154(b) by 118 days.

(21) Appl. No.: 10/680,585

(22) Filed: Oct. 6, 2003

(65) Prior Publication Data

US 2005/0072099 A1 Apr. 7, 2005

(51) Int. Cl.
*E04B 1/00* (2006.01)

(52) U.S. Cl. ..... 52/712; 52/713; 52/714; 403/231

(58) Field of Classification Search ..... 52/712, 52/293.3, 713, 714, 23; 403/231, 403, 382
See application file for complete search history.

(56) References Cited

U.S. PATENT DOCUMENTS 651,139 A 6/1900 Gays
1,486,509 A * 3/1924 Whittaker ..... 52/215
2,413,362 A * 12/1946 Maxwell et al. ..... 403/403
2,666,238 A 1/1954 Hagedorn
2,704,868 A 3/1955 Danielson
2,911,690 A * 11/1959 Sanford ..... 403/232.1
3,036,347 A * 5/1962 Findleton ..... 403/217
4,196,556 A * 4/1980 Russo ..... 52/714
4,230,416 A 10/1980 Gilb
4,423,977 A 1/1984 Gilb
4,480,941 A 11/1984 Gilb et al.
4,530,194 A * 7/1985 Linton et al. ..... 52/712
4,570,407 A 2/1986 Palacio et al.
4,594,017 A * 6/1986 Hills ..... 403/6
4,713,923 A * 12/1987 Sielaff et al. ..... 52/713
4,714,372 A 12/1987 Commins (Continued)

FOREIGN PATENT DOCUMENTS

GB 2 026 124 A 1/1980

OTHER PUBLICATIONS

United Steel Products Company, "USP Kant-Sag Silver Lumber Connector," RSPT4 Reversible Stud Plate Tie, United Steel Products Company (Minnesota & California), (1 page) , (as early as Mar. 26, 1998).

(Continued)

*Primary Examiner*—Carl D. Friedman
*Assistant Examiner*—Basil Katcheves
(74) *Attorney, Agent, or Firm*—Law Offices of James R. Cypher; Charles R. Cypher

(57) ABSTRACT

A connection in wood frame construction such as in frame walls of homes, wood framed apartment buildings and light wood framed commercial buildings. Specifically, the disclosure describes a pair of connectors for joining wall studs to a base plate and to a top plate for framing a wall. The two connectors used in the connection are identical and include an edge member for connection to the edge faces of the stud and the base or top plates, and a face member for engaging the lower face of the base plate or the upper face of the top plate. The face member is joined to the edge member and projects at a right angle thereto. The face member serves the dual purposes of locating the connected at the ends of the studs and of resisting tension forces.

12 Claims, 13 Drawing Sheets

U.S. PATENT DOCUMENTS

| | | | | | |
|---|---|---|---|---|---|
| 4,730,971 | A | | 3/1988 | Lin | |
| 4,896,985 | A | | 1/1990 | Commins | |
| 4,928,867 | A | | 5/1990 | Jensen | |
| 5,109,646 | A | | 5/1992 | Colonias et al. | |
| 5,150,982 | A | | 9/1992 | Gilb | |
| 5,259,685 | A | * | 11/1993 | Gilb | 403/231 |
| 5,335,469 | A | | 8/1994 | Stuart | |
| 5,380,115 | A | | 1/1995 | Colonias | |
| 5,380,116 | A | | 1/1995 | Colonias | |
| 5,403,110 | A | | 4/1995 | Sammann | |
| 5,410,854 | A | | 5/1995 | Kimmell et al. | |
| 5,488,810 | A | | 2/1996 | Horton | |
| 5,555,694 | A | | 9/1996 | Commins | |
| 5,697,725 | A | | 12/1997 | Ballash et al. | |
| 6,131,361 | A | * | 10/2000 | Murphy | 52/712 |
| 6,230,466 | B1 | | 5/2001 | Pryor | |

OTHER PUBLICATIONS

United Steel Products Company, "Angles and Straps," United Steel Products Company (U.S.A.), (1 page), (1998).

Simpson Strong-Tie Company, Inc., "Simpson Strong-Tie Connectors," RSP Stud Plate Ties, Simpson Strong-Tie Company, Inc. (U.S.A.), (1 page), (1995).

Simpson Strong-Tie Company, Inc., "AC/LPC Post Caps, BC Post Caps/Bases, APS Aluminum Post Standoff," Catalog C-96, Simpson Strong-Tie Company, Inc. (USA), p. 29 (1 page), (1995).

Simpson Strong-Tie Company, Inc., "Wood Construction Connectors," A angles/Z clips, SP/RSP, Catalog C-96, Simpson Strong-Tie Company, Inc. (U.S.A.), Title page and p. 59 (2 pages), (1995).

Hughes Manufacturing, Inc., "1997/1998 Product Catalog," Hughes Manufacturing, Inc. (Largo, Florida), Title page and p. 23 (2 pages), (1997).

Simpson Strong-Tie Company, Inc., "Connectors for Wood Construction Product & Instruction Manual," Catalog C-95H-1, Simpson Strong-Tie Company, Inc. (U.S.A.), Title page and p. 55 (2 pages), (1994).

Simpson Strong-Tie Company, Inc., "Wood Construction Connectors," The Well-Connected Structure, Catalog C-98, Simpson Strong-Tie Company, Inc. (U.S.A.), p. Title page and p. 38, 39, 51 and 61 (5 pages), (1997).

Simpson Strong-Tie Company, Inc., "Wood Construction Connectors," Catalog C-2003, Simpson Strong-Tie Company, Inc. (U.S.A.), Title page, back page, p. 4 and 13 (4 pages), (2002).

United Steel Products Company, "USP Lumber Connectors," Strap Ties—KHST, KRPS & PS Series, United Steel Products Company (U.S.A.), front, back and p. 84, (2000).

Simpson Strong-Tie Company, Inc., "Wood Construction Connectors," Simpson Strong-Tie, Inc. (U.S.A.), front, back and pp. 105 & 114, (2003).

Simpson Strong-Tie Company, Inc., "Wood Construction Connectors," Simpson Strong-Tie Comapny, Inc. (U.S.A.), front, back and pp. 68, 97, 109, 117, 119, 122-125, 131, 135-140 (2002).

* cited by examiner

TOP FLANGE STUD TO PLATE TIE

BACKGROUND OF THE INVENTION

The most common connection in the construction of a residential or light frame commercial building is the connection of the vertical wall framing studs to the bottom and top horizontal wood plates. This connection is most commonly made by toe nailing at an angle through an end of the stud into the respective top or bottom wood plate.

The problem with the toe nail stud to plate connection is the fact that end splitting of the stud is common; particularly if installation is effected by an unskilled workman but the main problem is that toe nailing creates inadequate resistance to uplift where the structure is subject to earthquake or high wind forces.

Some commercially available metal connectors have been placed on the market, which decrease wood splitting and improve uplift resistance, but these metal connectors do not provide indexing for both single and double plates with the same part of the connector. Moreover, none provide tension resistance in addition to that provided by the fasteners with the same part used for indexing.

BRIEF SUMMARY OF THE INVENTION

The gist of the present invention is to provide a sheet metal connector for connecting vertical studs to horizontal wood plates which is easier to use and to install than presently known connectors and which can resist greater uplift loads.

The present invention provides a pair of identical connectors, attached to the stud and plates of a building wall, that resist tension loads through fasteners and a face member flange.

A still further purpose of the present connector is to provide a single connector which can be interchangeably used to connect the stud to either a top double wood plate or a bottom single wood plate.

Another purpose of the present connector is to provide easy installation by allowing for full hammer strokes and quick installation with the best line of sight installation by providing that all nails are installed on the outside surface of the stud and plates.

A further objective is to provide a connector in which all fasteners are in shear resistance rather than "pull-out" resistance.

DETAILED DESCRIPTION OF THE INVENTION

Figure 1:
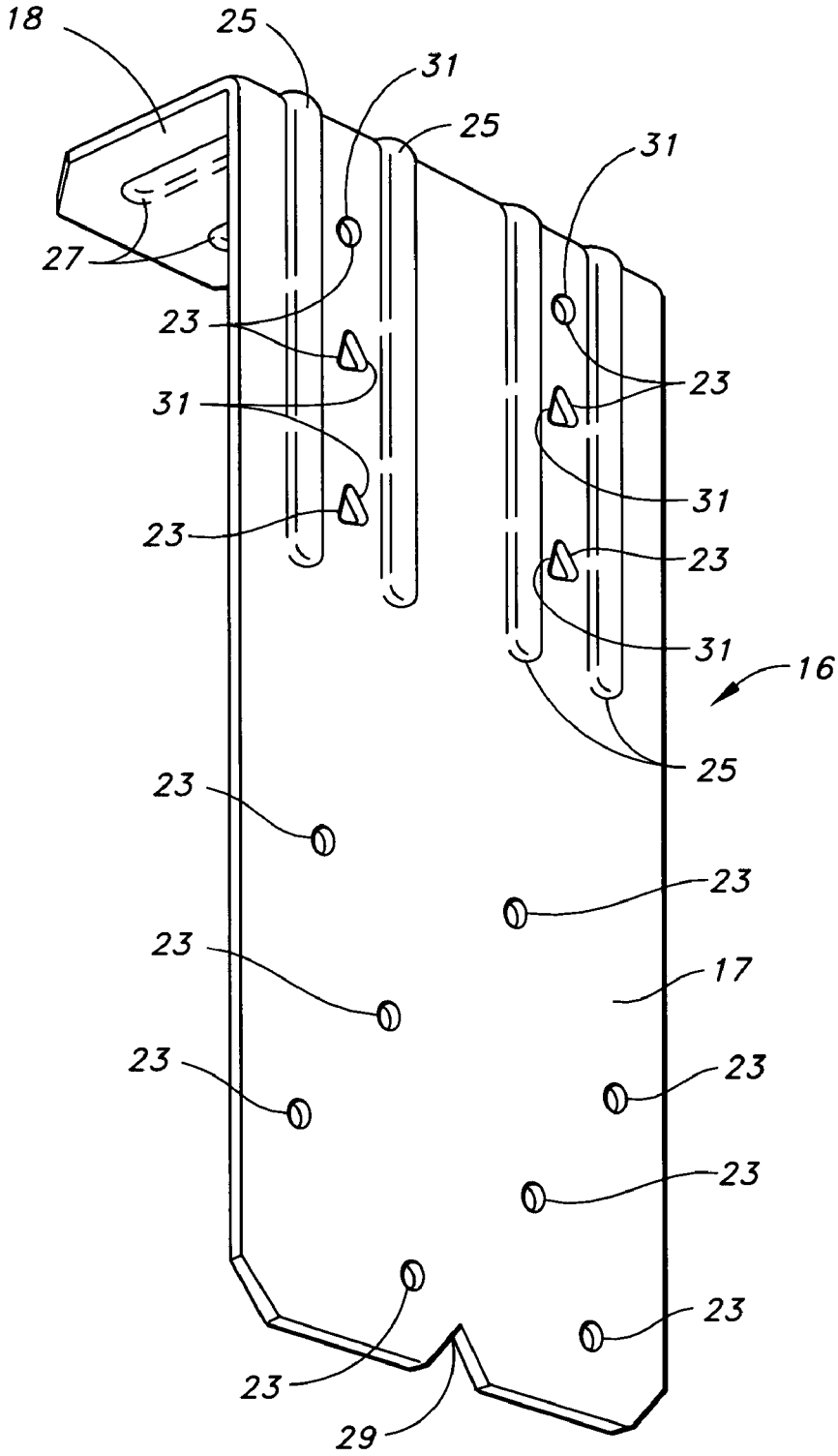
FIG. 1 is a perspective view of a preferred embodiment of the first stud to plate tie connector of the present invention.

As best seen in FIG. 3, FIG. 12, FIG. 17 and FIG. 18, the present invention is a stud to plate tie connection 1 in a wood frame structure 2. The connection comprises a base plate 3, a top plate 7, an elongated stud 11, a first stud to plate tie connector 16, and a second stud to plate tie connector 20. The base plate 3, top plate 7 and elongated stud 11 are all typically nominal 2×4 wood members. Most typically, the base plate 3 is a single width, while the top plate 7 is typically a double width. The stud 11 is typically either a single 2×4 or a double 2×4, although triple ply or greater are also possible. These structural members could also be a material other than wood, such as steel. The base plate 3 has an upper face 4, a lower face 5, and an edge face 6. The top plate 7 has an upper face 8, a lower face 9, and an edge face 10. The elongated stud 11 has sides 12 and an edge face 13 therebetween and has an upper end 14 in abutting registration with the lower face 9 of the top plate 7 and a lower end 15 in abutting registration with the upper face 4 of the base plate 3. The first stud to plate tie connector 16 has an edge member 17, and a face member 18 connected to the edge member 17 and projecting at a right angle thereto for engaging the lower face 5 of the base plate 3. A plurality of fasteners 19 pass through the edge member 17 into the edge face 13 of the stud 11 and into the edge face 6 of the base plate 3. The second stud to plate tie connector 20 identical to the first stud to plate tie connector 16 has an edge member 21, and a face member 22 connected to the edge member 21 and projecting at a right angle thereto for engaging the upper face 8 of the top plate 7. A plurality of fasteners 19 pass through the edge member 21 into the edge face 13 of the stud 11 and into the edge face 10 of the top plate 7.

Figure 3:
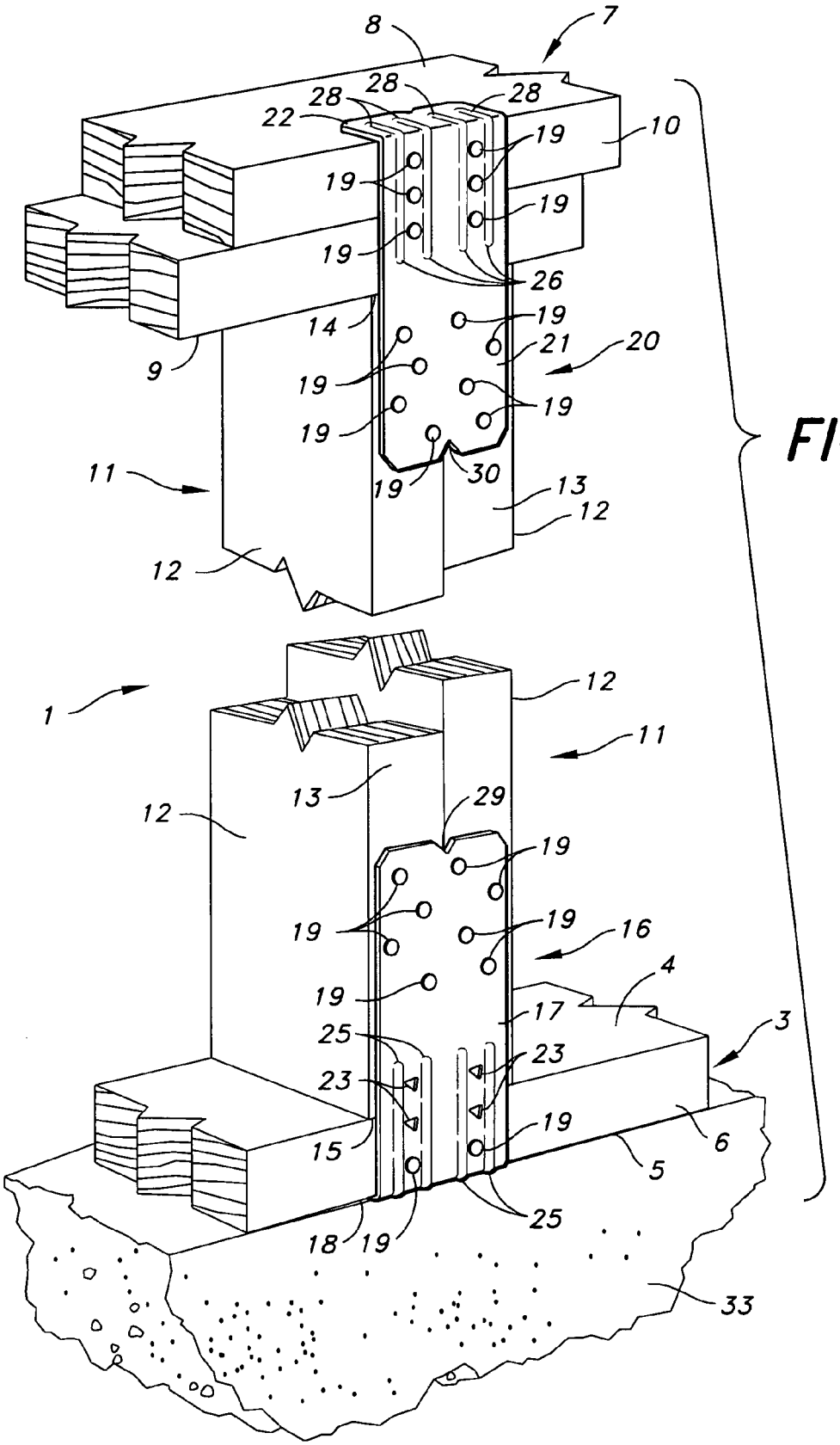
FIG. 3 is a perspective view of a preferred embodiment of the connection of the present invention.
Figure 12:
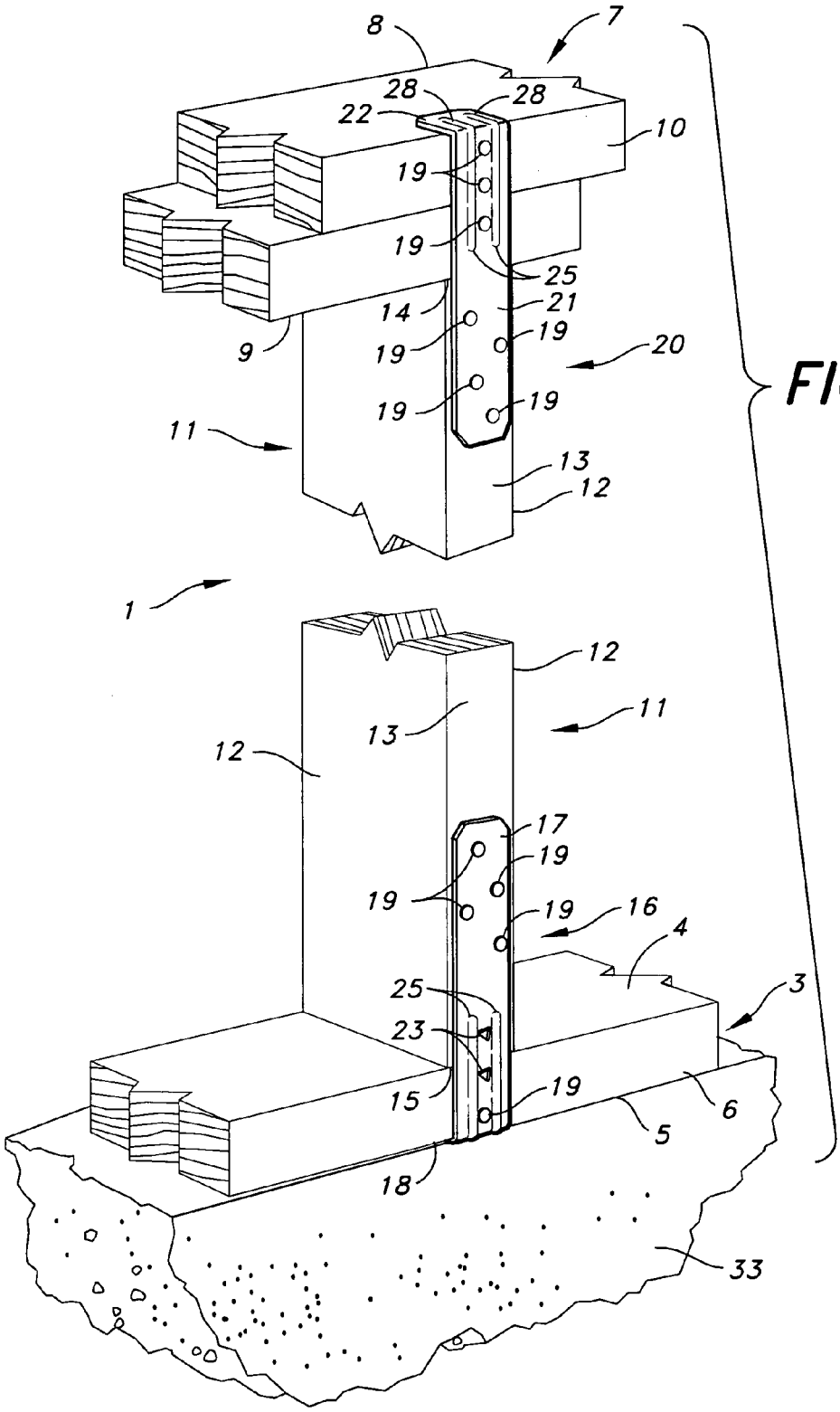
FIG. 12 is a perspective view of a preferred embodiment of the connection of the present invention.
Figure 13:
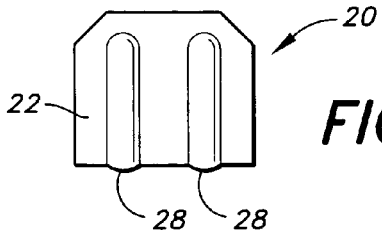
FIG. 13 is an elevation view of a first end of a preferred embodiment of the second stud to plate tie connector of the present invention showing the face member.
Figure 14:
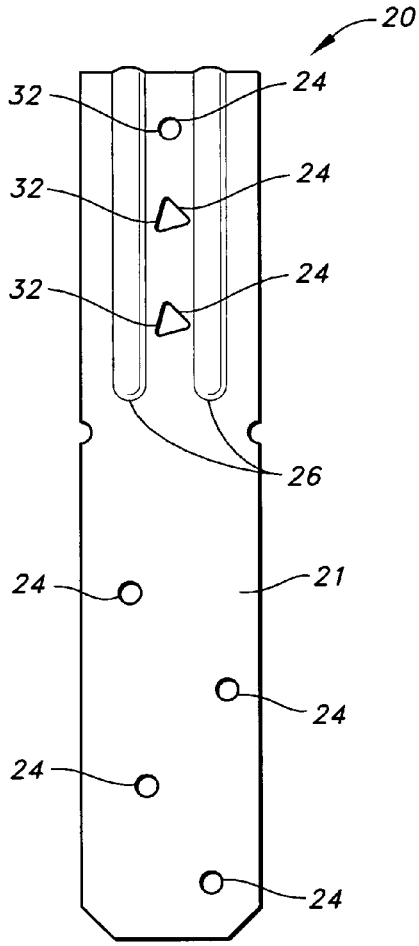
FIG. 14 is a front elevation view of a preferred embodiment of the second stud to plate tie connector of the present invention showing the edge member.
Figure 15:
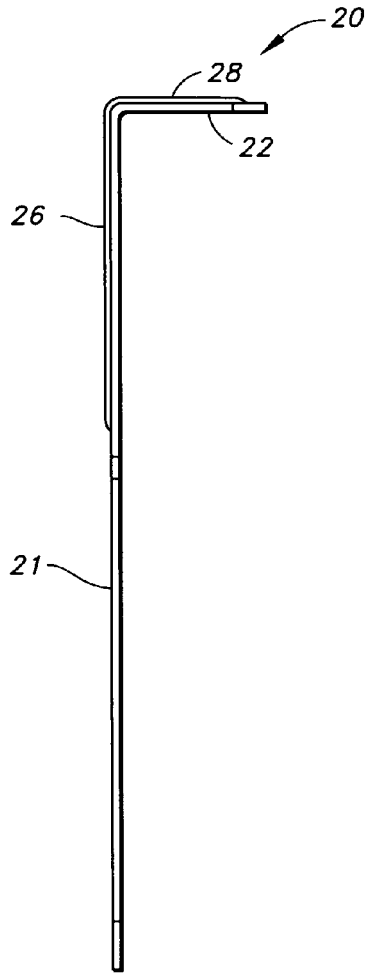
FIG. 15 is a side elevation view of a preferred embodiment of the second stud to plate tie connector of the present invention showing the face member and the edge member.
Figure 16:
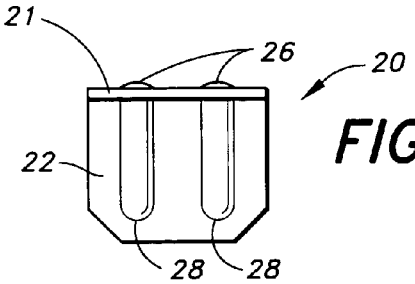
FIG. 16 is an elevation view of a second end of a preferred embodiment of the second stud to plate tie connector of the present invention showing the face member and an end of the edge member.
Figure 17:
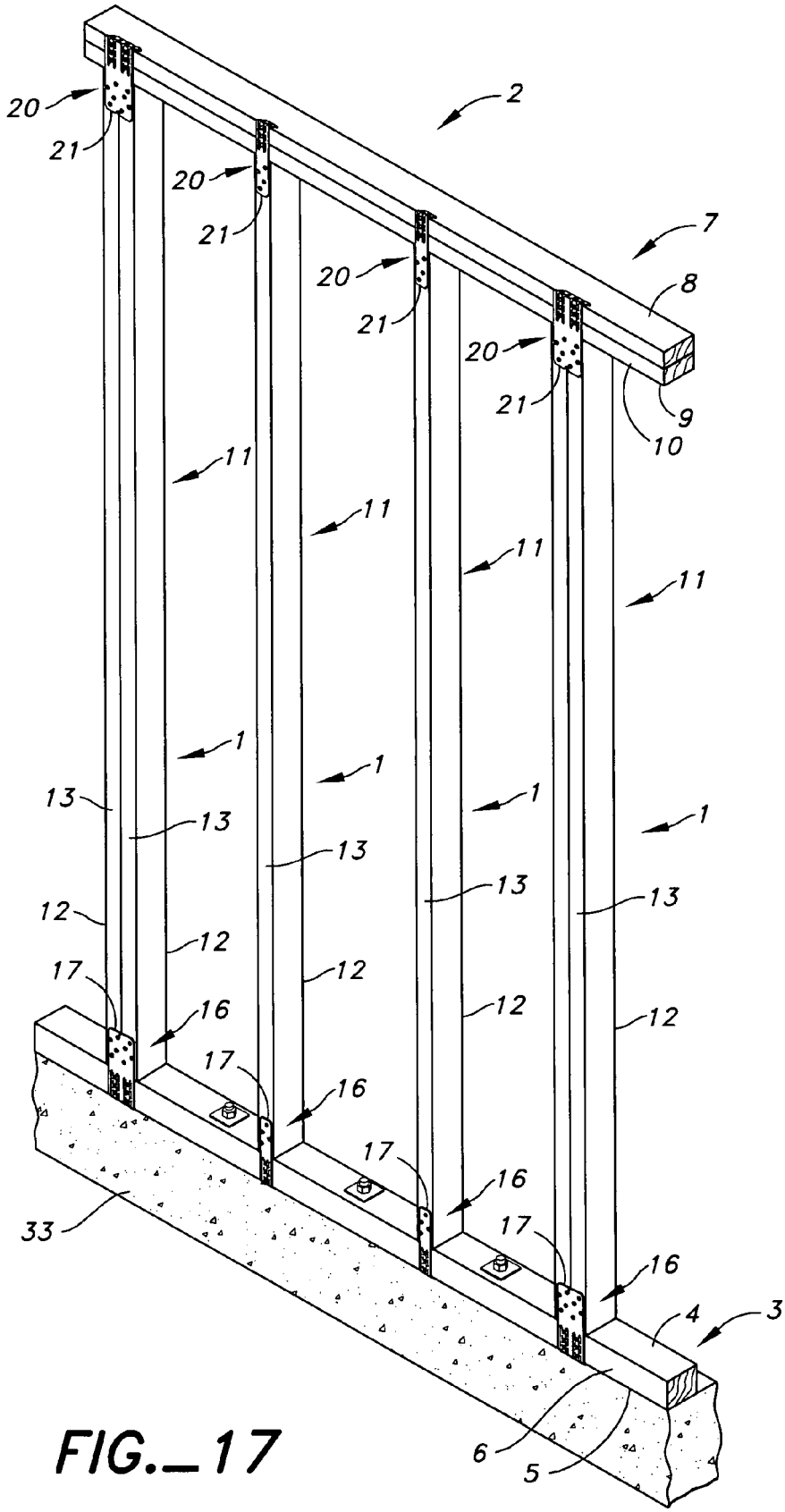
FIG. 17 is a perspective view of a wall section showing multiple connections of the present invention with a single ply base plate and a concrete foundation as the underlying structural member.
Figure 18:
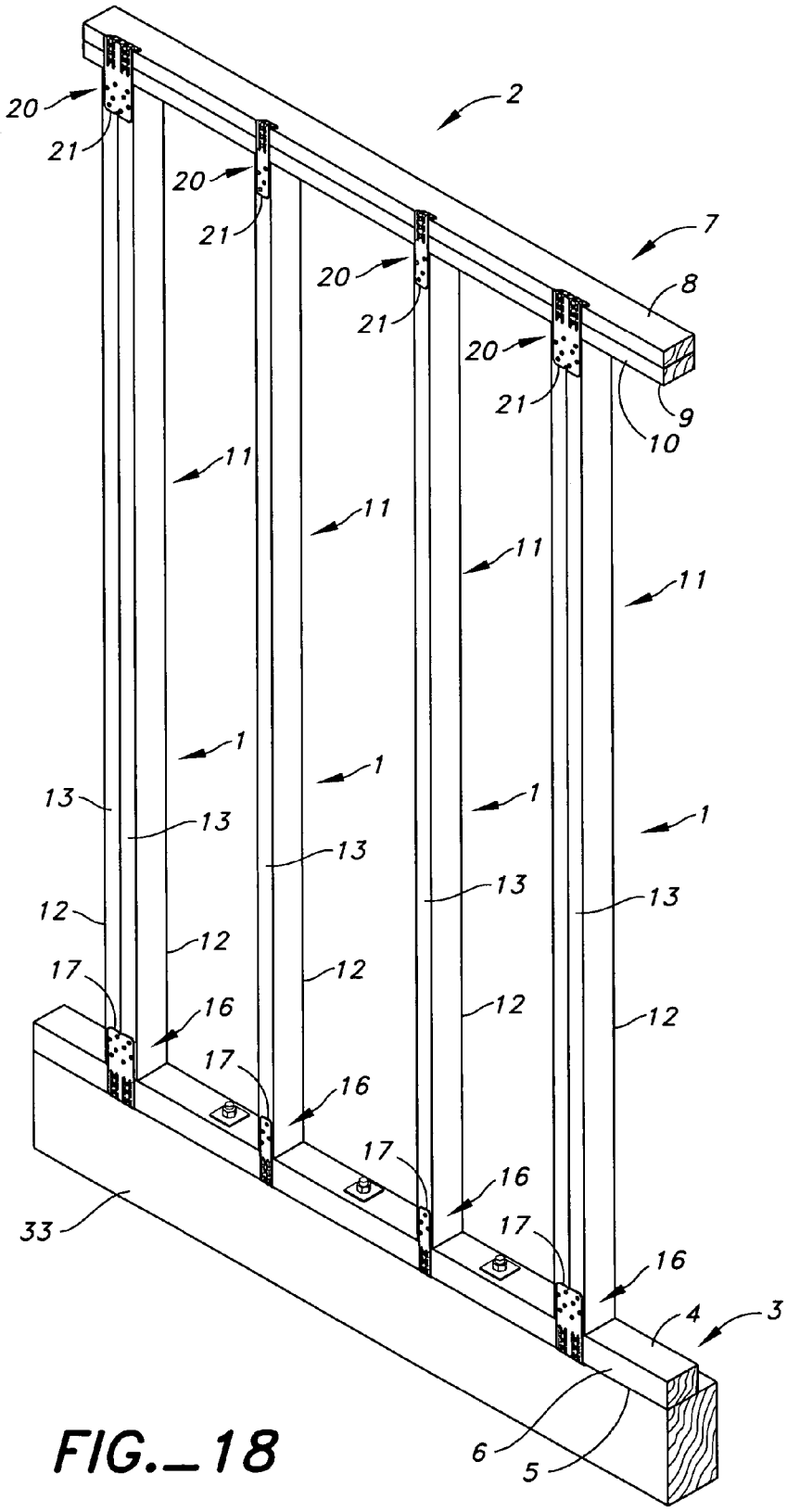
FIG. 18 is a perspective view of a wall section showing multiple connections of the present invention with a double ply base plate and a subfloor as the underlying structural member.

As best seen in FIG. 3, FIG. 12 and FIG. 17, preferably one of the top plate 7 and the base plate 3 is a double ply of wood. The plies are preferably nominal 2×4 wood members, running parallel, one on top of the other, narrow faces vertically side by side, two of the broad faces face-to-face. A single ply base plate 3 is preferred because compression loads crush the lumber, and a single ply is less material to crush. A double top plate 7 is preferred because it allows the wood members to be lapped at wall corners and where one wood member ends and another continues. The actual dimensions of nominal 2×4 lumber are 1½ inches by 3½ inches. The preferred embodiments of the stud to plate tie connectors 16 and 20 of the present invention were engineered for use with nominal 2×4 lumber.

Figure 6:
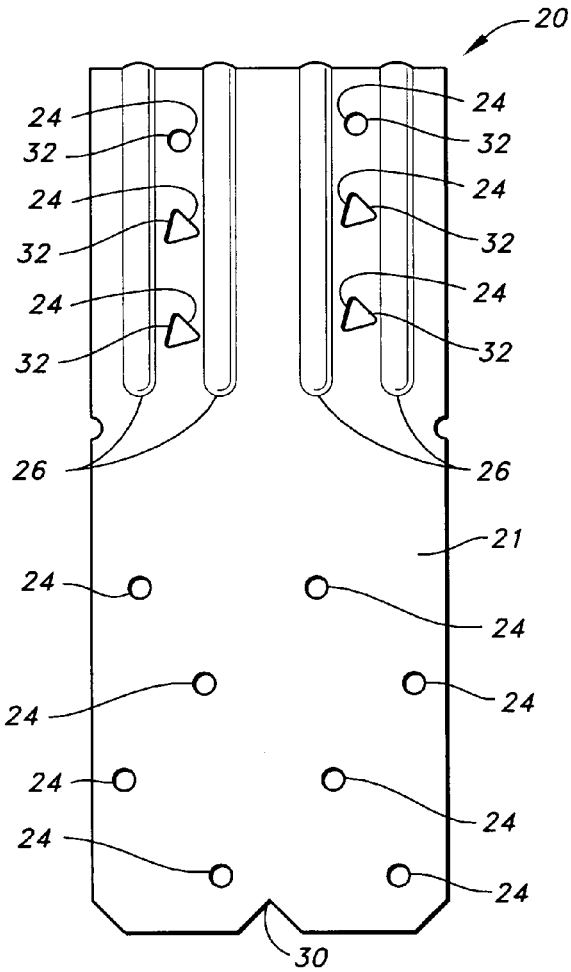
FIG. 6 is a front elevation view of a preferred embodiment of the second stud to plate tie connector of the present invention showing the edge member.
Figure 7:
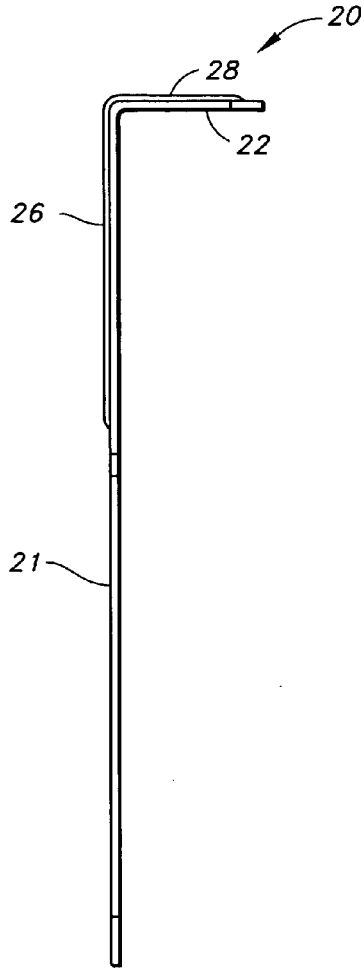
FIG. 7 is a side elevation view of a preferred embodiment of the second stud to plate tie connector of the present invention showing the face member and the edge member.
Figure 8:
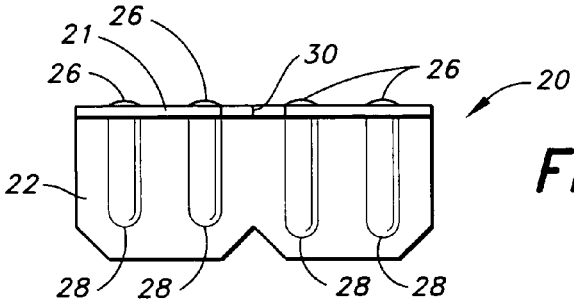
FIG. 8 is an elevation view of a second end of a preferred embodiment of the second stud to plate tie connector of the present invention showing the face member and an end of the edge member.
Figure 9:
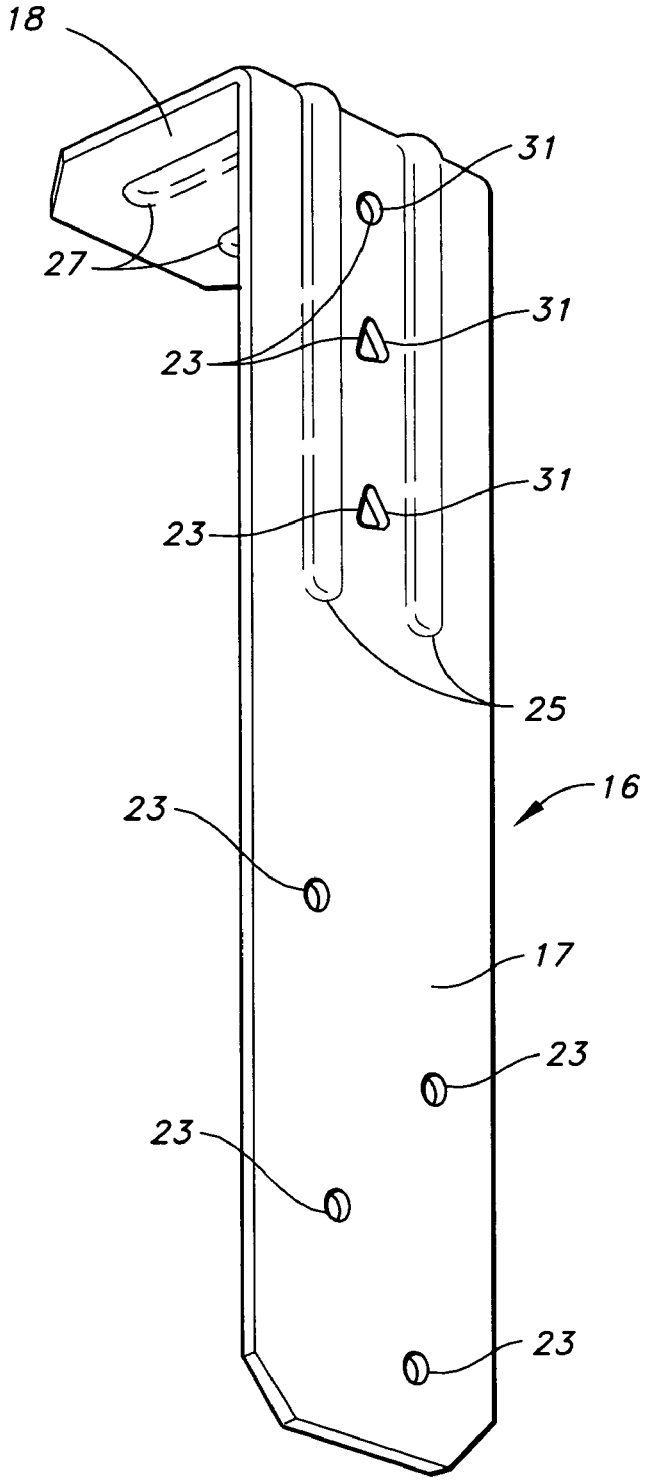
FIG. 9 is a perspective view of a preferred embodiment of the first stud to plate tie connector of the present invention.

As best seen in FIG. 1, preferably the first stud to plate tie connector 16 has fastener openings 23 in the edge member 17. As best seen in FIG. 6, the second stud to plate tie connector 20 has fastener openings 24 in the edge member 21.

Figure 2A:
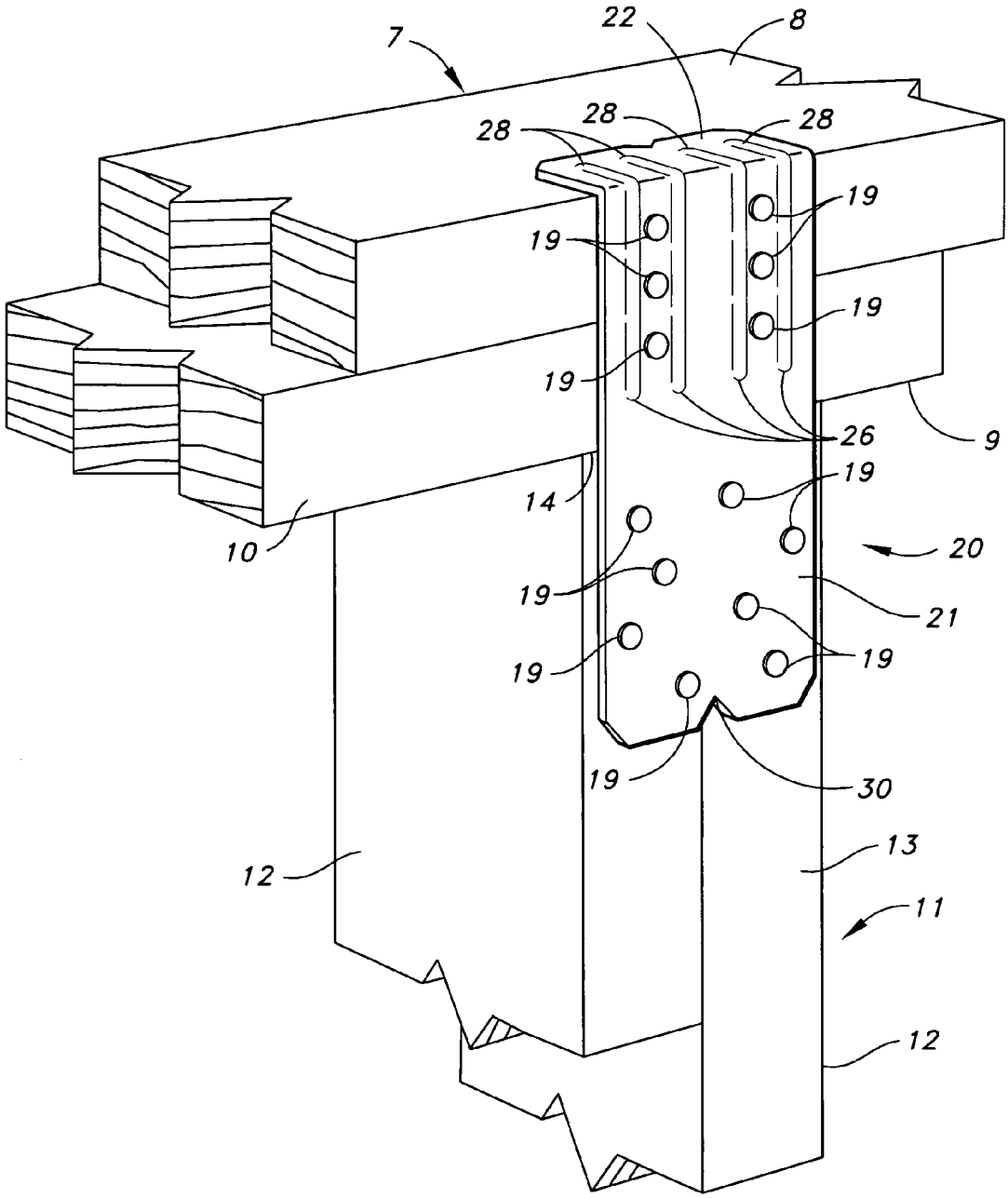
FIG. 2A is a perspective view of a preferred embodiment of the second stud to plate tie connector of the present invention in the connection of the present invention.
Figure 2B:
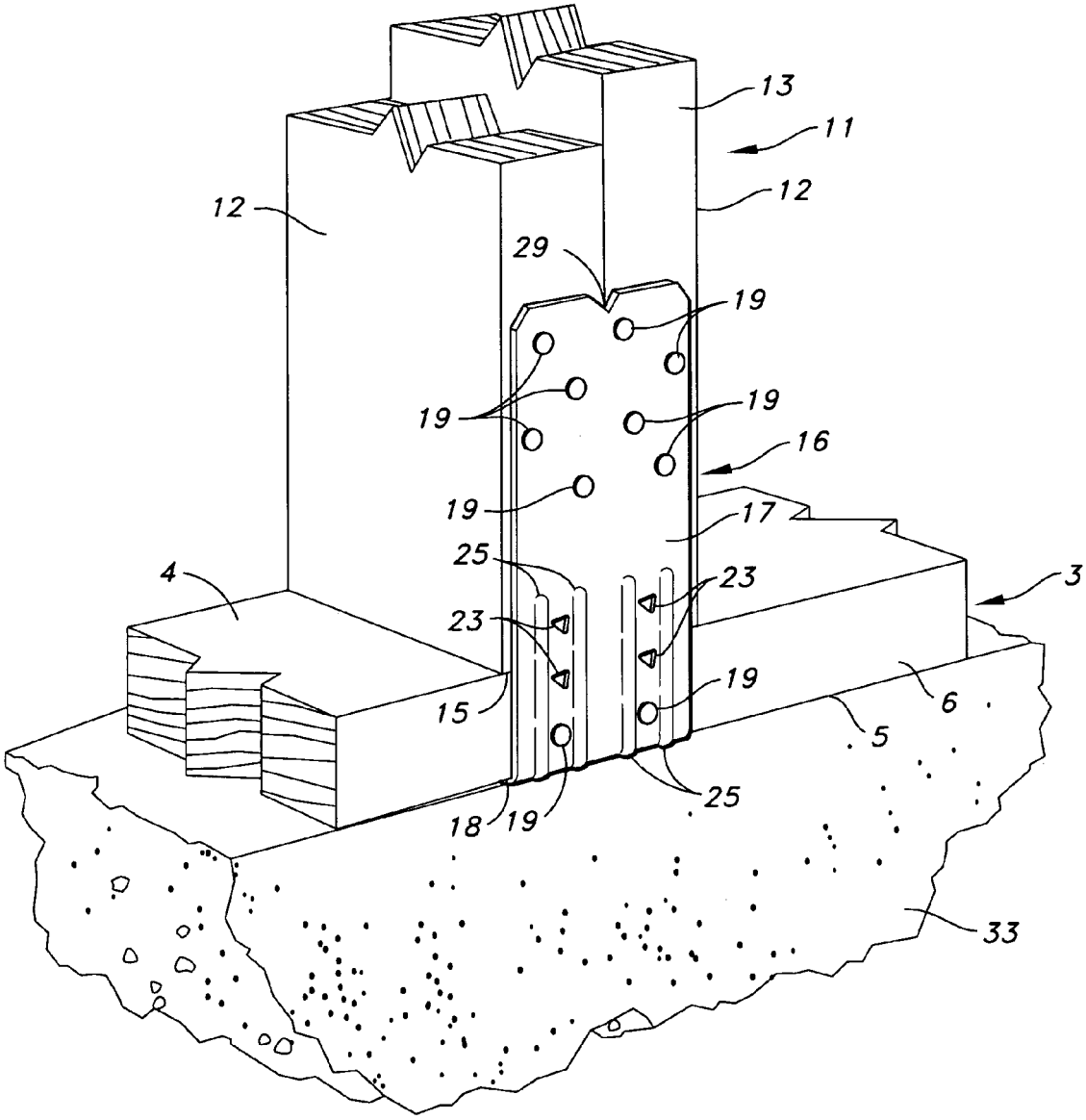
FIG. 2B is a perspective view of a preferred embodiment of the first stud to plate tie connector of the present invention in the connection of the present invention.
Figure 10A:
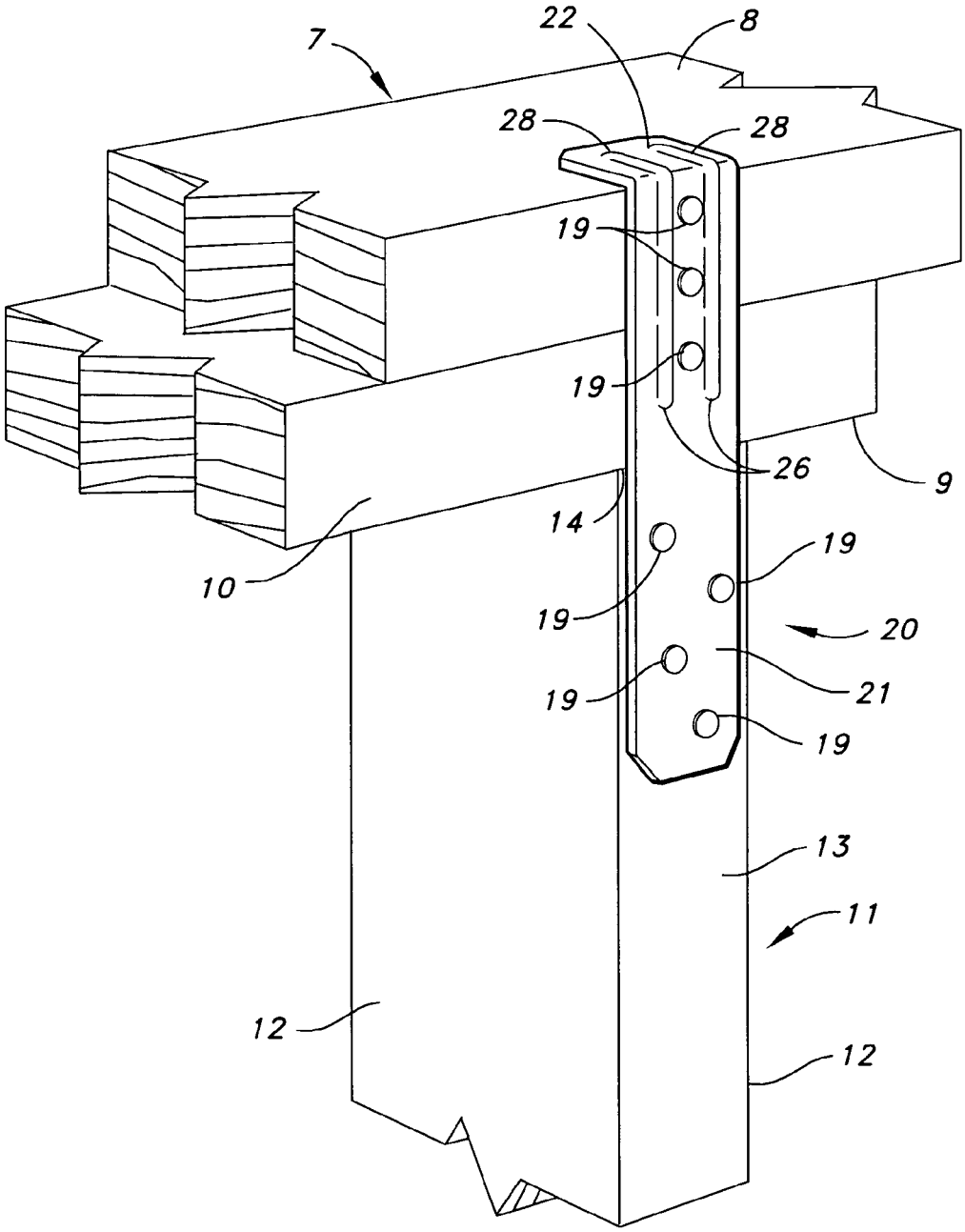
FIG. 10A is a perspective view of a preferred embodiment of the second stud to plate tie connector of the present invention in the connection of the present invention.
Figure 10B:
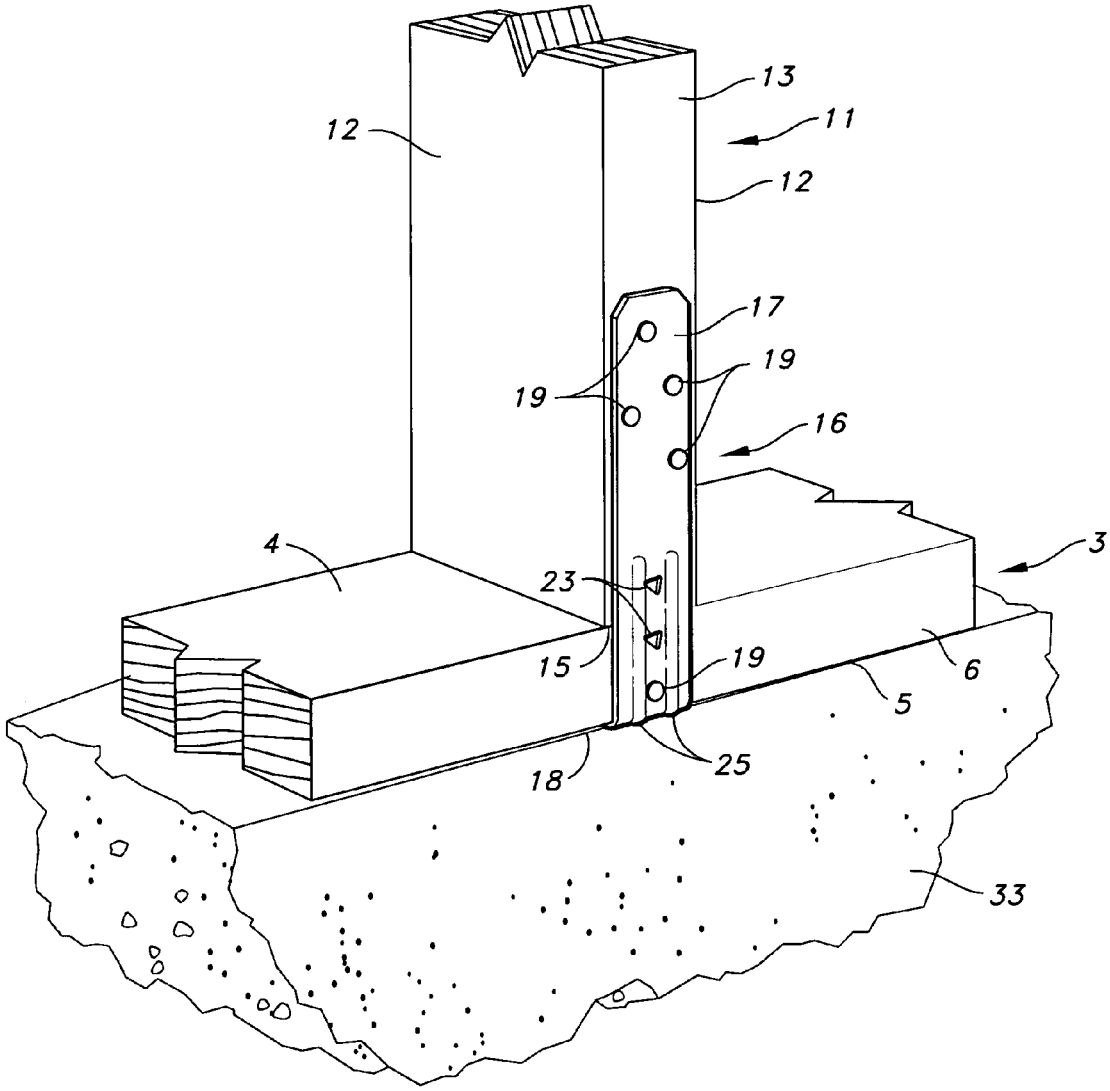
FIG. 10B is a perspective view of a preferred embodiment of the first stud to plate tie connector of the present invention in the connection of the present invention.

As best seen in FIGS. 2B and 10B, preferably the fastener openings 23 in the edge member 17 of the first stud to plate tie 16 are spaced so that when the face member 18 of the first stud to plate tie 16 engages the lower face 5 of the base plate 4 at least one of the plurality of fasteners 19 passes through one of the fastener openings 23 in the edge member 17 directly into the edge face 13 of the stud 11 and at least one of the plurality of fasteners 19 passes through one of the fastener openings 23 in the edge member 17 directly into the base plate 3. As best seen in FIG. 2A and FIG. 10A, preferably the fastener openings 24 in the edge member 21 of the second stud to plate tie 20 are spaced so that when the face member 22 of the second stud to plate tie 20 engages the upper face 8 of the top plate 7 at least one of the plurality of fasteners 19 passes through one of the fastener openings 24 in the edge member 21 directly into the edge face 13 of the stud 11 and at least one of the plurality of fasteners 19 passes through one of the fastener openings 24 in the edge member 21 directly into the top plate 7.

As best seen in FIG. 2B and 10B, preferably, at least four of the plurality of fasteners 19 pass through the fastener openings 23 in the edge member 17 of the first stud to plate tie 16 into the stud 11. As best seen in FIG. 2A and 10A, at least four of the plurality of fasteners 19 pass through the fastener openings 24 in the edge member 21 of the second stud to plate tie 20 into the stud 11.

Preferably, the fastener openings 23 and 24 are staggered to prevent splitting the lumber with the plurality of fasteners 19. Testing arrived at four fasteners as giving the maximum load values. Additional fasteners in the stud 11 would not substantially increase load values. When used with nominal 2×4 wood members, the preferred distance from the nearest of these four fasteners to the face member is 4 inches.

As best seen in FIG. 1, FIG. 4, FIG. 9 and FIG. 11, most preferably each of the first and second stud to plate tie connectors 16 and 20 has four fastener openings 23 or 24 for attaching to a single ply stud 11 and eight fastener openings 23 or 24 for attaching to a double ply stud 11. Preferably, each of the first and second stud to plate tie connectors 16 and 20 has three fastener openings 23 or 24 that could be used for attaching to the base plate 3 or top plate 7 when there is a single ply stud 11. One of the fastener openings 23 or 24 is used when the base plate 3 or top plate 7 is single ply; all three of the fastener openings 23 or 24 are used when the base plate 3 or top plate 7 is double ply. Preferably, each of the first and second stud to plate tie connectors 16 and 20 has six fastener openings 23 or 24 that could be used for attaching to the base plate 3 or top plate 7 when there is a double ply stud 11. Two of the fastener openings 23 or 24 are used when the base plate 3 or top plate 7 is single ply; all six of the fastener openings 23 or 24 are used when the base plate 3 or top plate 7 is double ply. Preferably, the fastener openings 23 and 24 for base plate connection are laterally centered in line on a stud to plate tie connector 16 or 20 designed for use with a single ply stud 11, and the spacing is centered on either side of a center line on a stud to plate tie connector 16 or 20 designed for use with a double ply stud 11. On a stud to plate tie connector 16 or 20 designed for use with a single ply 2×4 stud 11, the fastener openings 23 and 24 for base plate connection nearest the face member 18 or 22 is preferably ⅜ inches from the face member 18 or 22. The next is preferably 1 1/16 inches from the face member 18 or 22 and the third is preferably 1⅞ inches from the face member 18 or 22. On a stud to plate tie connector 16 or 20 designed for use with a double ply 2×4 stud 11, the second row of fastener openings 23 and 24 for base plate connection are each slightly further away from the face member 18 or 22, ½ inches, 1 3/16 inches, and 2 inches, respectively.

As best seen in FIG. 1, FIG. 4, FIG. 9 and FIG. 11, preferably the first stud to plate tie 16 additionally comprises reinforcing embossments 25 in the edge member 17, and the second stud to plate tie (20) additionally comprises reinforcing embossments 26 in the edge member 21. Preferably, there are two embossments 25 and 26 when there is a single ply stud 11 and four when there is a double ply stud 11. Testing has shown that these embossments reinforce the juncture between the edge members 17 and 21 and the face member 18 and 22 of the stud to plate tie connectors 16 and 20 against bending, which is critical because under tension loads the connectors 16 and 20 will otherwise bend at the juncture or in the edge members 17 and 21 and allow the face members 18 and 22 to pull from below the base plate 3 or above the top plate 7. Preferably, the first stud to plate tie 16 additionally comprises reinforcing embossments 27 in the face member 18, and the second stud to plate tie 20 additionally comprises reinforcing embossments 28 in the face member 22. Preferably, there are two embossments 27 and 28 when there is a single ply stud 11 and four when there is a double ply stud 11. Preferably, the reinforcing embossments 25 in the edge member 17 and the reinforcing embossments 27 in the face member 18 of the first stud to plate tie 16 are connected and continuous, and the reinforcing embossments 26 in the edge member 21 and the reinforcing embossments 28 in the face member 22 of the second stud to plate tie 20 are connected and continuous.

As best seen in FIG. 3 and FIG. 12, preferably one of the top plate 7 and the base plate 3 is a double ply of wood, and at least two of the plurality of fasteners 19 enter the double ply of wood. Most preferably, three of the plurality of fastener 19 enter the double ply of wood. Preferably, three of the plurality of fasteners 19 enter the double ply of wood when there is a single ply stud 11, and six of the plurality of fasteners 19 enter the double ply of wood when there is a double ply stud 11.

Preferably, the edge member 17 of the first stud to plate tie 16 is substantially the same width as the edge face 13 of the stud 11, and the edge member 21 of the second stud to plate tie 20 is substantially the same width as the edge face 13 of the stud 11. Most preferably, the stud to plate ties 16 and 20 are 1⅜ inches wide for use with a single ply stud 11 and 2¾ inches wide for use with a double ply stud. This helps to ensure that the stud to plate tie connector 16 and 20 are within the edge face 13 of the stud 11. Preferably, the edge members 17 and 21 and the same width as the face members 18 and 22. Most preferably, the stud to plate ties 16 and 20 are 6 11/16 inches long in both cases. However, the stud to plate ties 16 and 20 can be made to other dimensions for other than nominal 2×4 lumber. Preferably, the stud to plate tie connectors 16 and 20 are made from 18 gauge sheet steel, cut, embossed, pierced and bent, but other thicknesses are possible, as are other materials than steel. The minimum thickness is essentially determined by load requirements, but it is otherwise preferable that the stud to plate tie connectors 16 and 20 be as thin as possible so that they do not interfere with attaching sheathing and other materials.

As best seen in FIG. 2A, FIG. 3, FIG. 10A and FIG. 12, preferably, the face member 18 of the first stud to plate tie 16 does not extend beyond the lower face 5 of the base plate 3, and the face member 22 of the second stud to plate tie 20 does not extend beyond the upper face 8 of the top plate 7. This is preferable because a projecting face member 18 or 22 would interfere with interfere with attaching sheathing and other materials.

Preferably, the plurality of fasteners 19 are nails, most preferably 10d×1½ or 10d nails, but other fasteners such as screws could be used.

As best seen in FIG. 3, in a preferred embodiment the elongated stud 11 is a double ply of wood. If so, the edge member 17 of the first stud to plate tie 16 has a visual guide 29 to aid in centrally aligning the first stud to plate tie 16 on the double ply stud 11, and the edge member 21 of the second stud to plate tie 20 has a visual guide 30 to aid in centrally aligning the second stud to plate tie 20 on the double ply stud 11. Preferably, the visual guides 29 and 30 are notches centered in the end of the edge members 17 and 21 away from the face members 18 and 22. However, another form of visual guide or marking could be used.

As best seen in FIG. 3 and FIG. 12, preferably the first stud to plate tie 16 additionally comprises visual indicia 31 to indicate which fastener openings 23 must be used when fastening a base plate 4 of a given dimension, and the second stud to plate tie 20 additionally comprises visual indicia 32 to indicate which fastener openings 24 must be used when fastening a top plate 7 of a given dimension. These visual indicia 31 and 32 could be markings or instructions on the stud to plate tie 16 and 20, embossed, engraved, printed or otherwise labeled. Preferably, the visual indicia 31 in the first stud to plate tie 16 are two different shapes of the fastener openings 23 in the edge member 17 of the first stud to plate tie 16, and the visual indicia 32 in the second stud to plate tie 20 are two different shapes of the fastener openings 24 in the edge member 21 of the second stud to plate tie 20. Preferably, the stud to plate ties 16 and 17 have, for single ply stud 11 installations, a single round fastener opening nearest the face member 18 or 22 and two triangular fastener openings. Only the round fastener opening is used when the base plate 3 or top plate 7 is single ply. The triangular fastener openings are used when the base plate 3 or top plate 7 is double ply. Preferably, the stud to plate ties 16 and 17 have, for double ply stud 11 installations, two round fastener openings nearest the face member 18 or 22 and four triangular fastener openings. Only the round fastener openings are used when the base plate 3 or top plate 7 is single ply. The triangular fastener openings are used when the base plate 3 or top plate 7 is double ply. Because the fastener openings 23 and 24 for plate attachment are preferably arranged in vertical lines, only the one (in the case of a single ply stud 11) or two (in the case of a double ply stud 11) are used with single ply plates. The next fastener or fasteners would tend to enter the single ply plate too close to the edge, thereby weakening the connecting by allowing the first fastener to break out of the plate more easily under tension, and the third fastener would go into the stud 11, which would do no harm, but which would also do little or nothing to improve load values. All of the fastener openings 23 and 24 can be used with double ply plates because those for plate attachments would all go into the plate and the middle fastener or fasteners would no longer do any harm because that ply would be reinforced by the adjacent one.

Preferably, this stud to plate tie connection 1 is formed by placing the edge member 17 of the first stud to plate tie connector 16 against the edge face 13 of the stud 11 and the edge face 6 of the base plate 3, and placing the face member 18 of the first stud to plate tie connector 16 against the lower face 5 of the base plate 3, driving at least one of the plurality of fasteners 19 through the edge member 17 of the first stud to plate tie connector 16 into the edge face 13 of the stud 11 and driving at least one of the plurality of fasteners 19 through the edge member 17 into the edge face 6 of the base plate 3. The edge member 21 of the second stud to plate tie connector 20 is placed against the edge face 13 of the stud 11 and the edge face 10 of the top plate 7, and the face member 22 of the second stud to plate tie connector 20 is placed against the upper face 8 of the top plate 7. The connection is completed by driving at least one of the plurality of fasteners 19 through the edge member 21 of the second stud to plate tie connector 20 into the edge face 13 of the stud 11 and driving at least one of the plurality of fasteners 19 through the edge member 21 into the edge face 10 of the top plate 7. The edge members 17 and 21 and the face members 18 and 22 are pre-bent to ease installation and indexing. As best seen in FIG. 2B, FIG. 3, FIG. 10B, FIG. 12, FIG. 17 and FIG. 18 preferably, the base plate 3 rests on an underlying structural member 33, and the face member 18 of the first stud to plate tie 16 is driven between the base plate 3 and the underlying structural member 33. When the connection is in a wall above the first story of a building, the underlying structural member 33 is a subfloor member. When the connection is in a first story wall, the underlying structural member 33 is a cementitious member, and the cementitious member is a concrete foundation.

The stud to plate tie connectors 16 and 20 of the present invention can be installed in a wall when it has been framed but not yet raised. The stud to plate tie connectors 16 and 20 of the present invention can also be installed in a wall that has already been raised, and as such they are suitable for retrofit applications. Preferably, the face members 18 and 22 are long enough and stiff enough to be driven between the plates and any underlying structural member 33 or overlying structure. The embossments 27 and 28 reinforce the face members 18 and 22 against bending under tension loads, but the embossments 27 and 28 also stiffen the face member 18 and 22 so they can be driven more easily and effectively. The stud to plate tie connectors 16 and 20 of the present invention can also be installed from the inside or outside of the wall.

Figure 4:
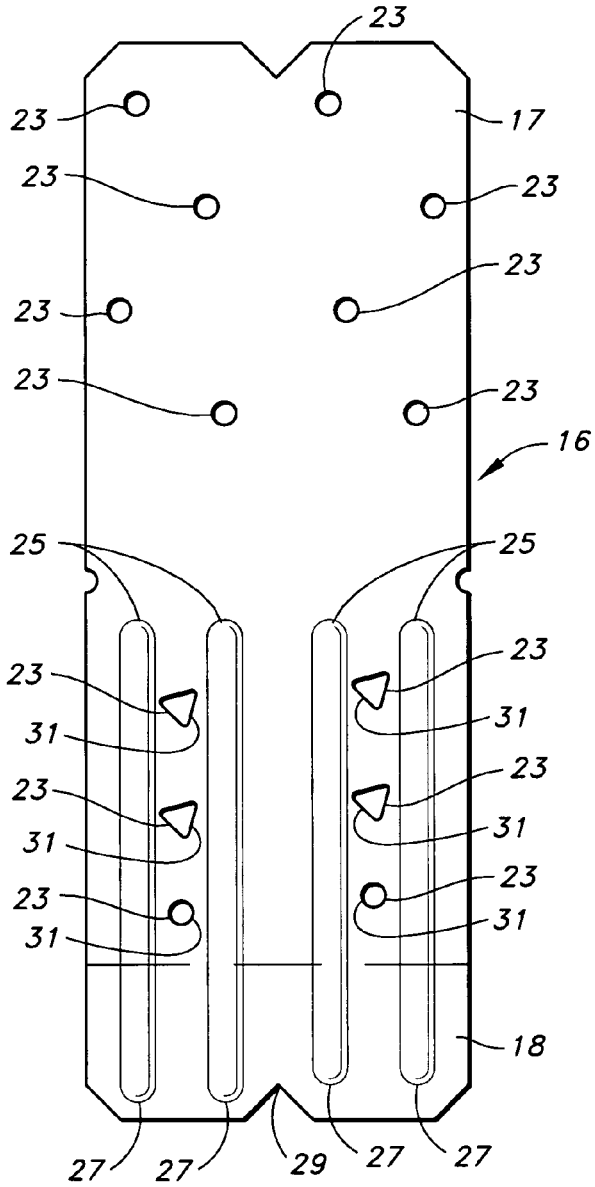
FIG. 4 is plan view of the blank of a preferred embodiment of the first stud to plate tie connector of the present invention.
Figure 11:
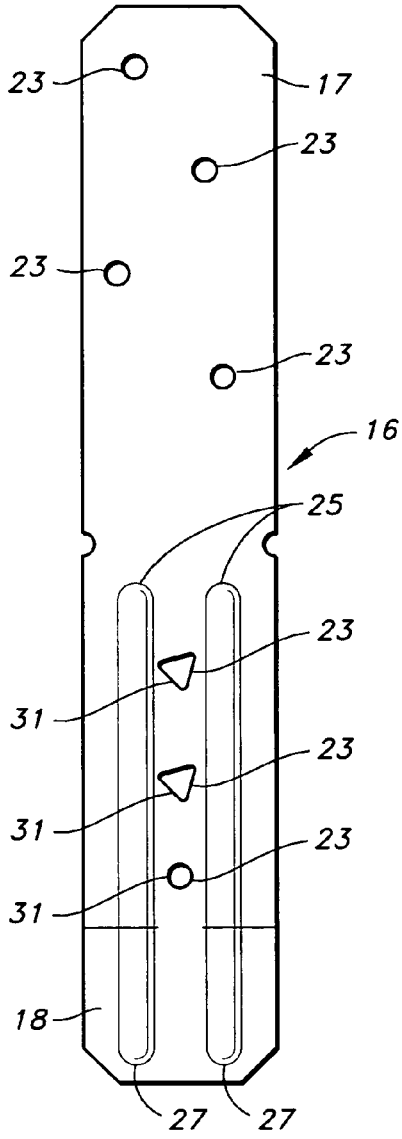
FIG. 11 is plan view of the blank of a preferred embodiment of the first stud to plate tie connector of the present invention.
Figure 5:
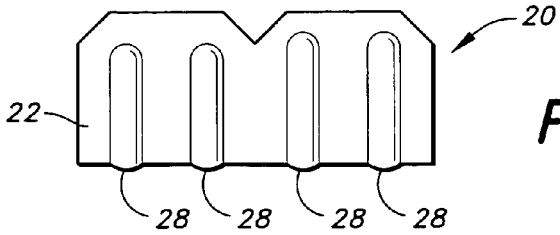
FIG. 5 is an elevation view of a first end of a preferred embodiment of the second stud to plate tie connector of the present invention showing the face member.

As best seen in FIG. 4 and FIG. 11, preferably the reinforcing embossments 25 in the edge member 17 of the first stud to plate tie connector 16 extend at least as far from the face member 18 as the one of the fastener openings 23 in the edge member 17 closest to the face member 18. Preferably, the reinforcing embossments 26 in the edge member 21 of the second stud to plate tie connector 20 extend at least as far from the face member 22 as the one of the fastener openings 24 in the edge member 21 closest to the face member 22. In a preferred embodiment, the reinforcing embossments 25 and 26 extend beyond all of the fastener openings 23 and 24 for plate attachment, and the exactly preferred length of the reinforcing embossments 25 and 26 is 2½ inches.

Preferably, the face member 18 of the first stud to plate tie connector 16 is at least one quarter the width of the lower face 5 of the base plate 3 as measured from the edge member 17 to the opposite side of the face member 18. Preferably, the face member 22 of the second stud to plate tie connector 20 is at least one quarter the width of the upper face 8 of the top plate 7 as measured from the edge member 21 to the opposite side of the face member 22. Preferably, the face members 18 and 22 are 1⅛ inches, and the reinforcing embossments 27 and 28 are ⅞ inches long.

Average ultimate loads are the average of the highest loads that were achieved when static load testing the preferred embodiments of the stud to plate tie connectors 16 and 20 of the present invention to destruction. With four 10d×1½ nails in the stud 11 and three 10d×1½ nails in a double top plate 7, when both the stud 11 and the double top plate 7 were douglas fir or southern pine, the average ultimate load for the preferred stud to plate tie connector 20, designed for a single ply stud 11, was 1107 pounds. With four 10d×1½ nails in the stud 11 and one 10d×1½ nail in a single base plate 3, when both the stud 11 and the single base plate 3 were douglas fir or southern pine, the average ultimate load for the preferred stud to plate tie connector 16, designed for a single ply stud 11, was 1360 pounds. With four 10d nails in the stud 11 and three 10d nails in a double top plate 7, when both the stud 11 and the double top plate 7 were douglas fir or southern pine, the average ultimate load for the preferred stud to plate tie connector 20, designed for a single ply stud 11, was 1310 pounds. With four 10d nails in the stud 11 and one 10d nail in a single base plate 7, when both the stud 11 and the single base plate 3 were douglas fir or southern pine, the average ultimate load for the preferred stud to plate tie connector 16, designed for a single ply stud 11, was 1397 pounds. With eight 10d×1½ nails in the stud 11 and six 10d×1½ nails in a double top plate 7, when both the stud 11 and the double top plate 7 were douglas fir or southern pine, the average ultimate load for the preferred stud to plate tie connector 20, designed for a double ply stud 11, was 2417 pounds. With eight 10d×1½ nails in the stud 11 and two 10d×1½ nails in a single base plate 3, when both the stud 11 and the single base plate 3 were douglas fir or southern pine, the average ultimate load for the preferred stud to plate tie connector 16, designed for a double ply stud 11, was 2160 pounds. With eight 10d nails in the stud 11 and six 10d nails in a double top plate 7, when both the stud 11 and the double top plate 7 were douglas fir or southern pine, the average ultimate load for the preferred stud to plate tie connector 20, designed for a double ply stud 11, was 2538 pounds. With eight 10d nails in the stud 11 and two 10d nails in a single base plate 7, when both the stud 11 and the single base plate 3 were douglas fir or southern pine, the average ultimate load for the preferred stud to plate tie connector 16, designed for a double ply stud 11, was 2474 pounds.

We claim:

1. A stud to plate tie connection (1) in a wall in a wood frame structure (2) comprising:

a. a base plate (3) having an upper face (4), a lower face (5), and an edge face (6);

b. a top plate (7) having an upper face (8), a lower face (9), and an edge face (10);

c. an elongated stud (11) having sides (12) and an edge face (13) therebetween and having an upper end (14) in abutting registration with said lower face (9) of said top plate (7) and a lower end (15) in abutting registration with said upper face (4) of said base plate (3);

d. a first stud to plate tie connector (16) having:

i. an edge member (17);

ii. a face member (18) connected to said edge member (17) and projecting at a right angle thereto engaging said lower face (5) of said base plate (3); and iii. a plurality of fasteners (19) passing through said edge member (17) into said edge face (13) of said stud (11) and into said edge face (6) of said base plate (3); and e. a second stud to plate tie connector (20) identical to said first stud to plate tie connector (16) having:

i. an edge member (21);

ii. a face member (22) connected to said edge member (21) and projecting at a right angle thereto engaging said upper face (8) of said top plate (7); and iii. a plurality of fasteners (19) passing through said edge member (21) into said edge face (13) of said stud (11) and into said edge face (10) of said top plate (7); wherein f. said first stud to plate tie connector (16) has fastener openings (23) in said edge member (17);

g. said second stud to plate tie connector (20) has fastener openings (24) in said edge member (21);

h. said fastener openings (23) in said edge member (17) of said first stud to plate tie (16) are spaced so that when said face member (18) of said first stud to plate tie (16) engages said lower face (5) of said base plate (4) at least one of said plurality of fasteners (19) passes through one of said fastener openings (23) in said edge member (17) directly into said edge face (13) of said stud (11) and at least one of said plurality of fasteners (19) passes through one of said fastener openings (23) in said edge member (17) directly into said base plate (3);

i. said fastener openings (24) in said edge member (21) of said second stud to plate tie (20) are spaced so that when said face member (22) of said second stud to plate tie (20) engages said upper face (8) of said top plate (7) at least one of said plurality of fasteners (19) passes through one of said fastener openings (24) in said edge member (21) directly into said edge face (13) of said stud (11) and at least one of said plurality of fasteners (19) passes through one of said fastener openings (24) in said edge member (21) directly into said top plate (7);

j. at least four of said plurality of fasteners (19) pass through said fastener openings (23) in said edge member (17) of said first stud to plate tie (16) into said stud (11);

k. at least four of said plurality of fasteners (19) pass through said fastener openings (24) in said edge member (21) of said second stud to plate tie (20) into said stud (11);

l. said first stud to plate tie connector (16) additionally comprises reinforcing embossments (25) in said edge member (17);

m. said second stud to plate tie connector (20) additionally comprises reinforcing embossments (26) in said edge member (21);

n. said first stud to plate tie connector (16) additionally comprises reinforcing embossments (27) in said face member (18);

o. said second stud to plate tie connector (20) additionally comprises reinforcing embossments (28) in said face member (22);

p. said reinforcing embossments (25) in said edge member (17) and said reinforcing embossments (27) in said face member (18) of said first stud to plate tie connector (16) are connected and continuous;

q. said reinforcing embossments (26) in said edge member (21) and said reinforcing embossments (28) in said face member (22) of said second stud to plate tie connector (20) are connected and continuous;

r. one of said top plate (7) and said base plate (3) is a double ply of wood;

s. at least two of said plurality of fasteners (19) enter said double ply of wood;

t. said edge member (17) of said first stud to plate tie connector (16) is substantially the same width as said edge face (13) of said stud (11);

u. said edge member (21) of said second stud to plate tie connector (20) is substantially the same width as said edge face (13) of said stud (11);

v. said face member (18) of said first stud to plate tie connector (16) does not extend beyond said lower face (5) of said base plate (3); and w. said face member (22) of said second stud to plate tie connector (20) does not extend beyond said upper face (8) of said top plate (7).

2. A stud to plate tie connection (1) as described in claim 1 wherein:

a. said plurality of fasteners (19) are nails.

3. A stud to plate tie connection (1) as described in claim 2 wherein:

a. said elongated stud (11) is a double ply of wood.

4. A stud to plate tie connection (1) as described in claim 3 wherein:

a. said edge member (17) of said first stud to plate tie connector (16) has a visual guide (29) for centrally aligning said first stud to plate tie connector (16) on said double ply stud (11); and b. said edge member (21) of said second stud to plate tie connector (20) has a visual guide (30) for centrally aligning said second stud to plate tie connector (20) on said double ply stud (11).

5. A stud to plate tie connection (1) as described in claim 1 wherein:

a. said first stud to plate tie connector (16) additionally comprises visual indicia (31) to indicate which fastener openings (23) must be used when fastening to a base plate (4) of a given dimension; and b. said second stud to plate tie connector (20) additionally comprises visual indicia (32) to indicate which fastener openings (24) must be used when fastening to a top plate (7) of a given dimension.

6. A stud to plate tie connection (1) as described in claim 5 wherein:

a. said visual indicia (31) in said first stud to plate tie connector (16) are two different shapes of said fastener openings (23) in said edge member (17) of said first stud to plate tie connector (16); and b. said visual indicia (32) in said second stud to plate tie connector (20) are two different shapes of said fastener openings (24) in said edge member (21) of said second stud to plate tie connector (20).

7. A stud to plate tie connection (1) as described in claim 6 wherein:

a. said first stud to plate tie connector (16) additionally comprises reinforcing embossments (25) in said edge member (17);

b. said second stud to plate tie connector (20) additionally comprises reinforcing embossments (26) in said edge member (21);

c. said reinforcing embossments (25) in said edge member (17) of said first stud to plate tie connector (16) extend at least as far from said face member (18) as the one of said fastener openings (23) in said edge member (17) closest to said face member (18); and d. said reinforcing embossments (26) in said edge member (21) of said second stud to plate tie connector (20) extend at least as far from said face member (22) as the one of said fastener openings (24) in said edge member (21) closest to said face member (22).

8. A stud to plate tie connection (1) as described in claim 7 wherein:

a. said face member (18) of said first stud to plate tie connector (16) is at least one quarter the width of said lower face (5) of said base plate (3) as measured from the edge member (17) to the opposite side of said face member (18); and b. said face member (22) of said second stud to plate tie connector (20) is at least one quarter the width of said upper face (8) of said top plate (7) as measured from the edge member (21) to the opposite side of said face member (22).

9. A method of forming a stud to plate tie connection (1) comprising:

a. selecting a base plate (3) having an upper face (4), a lower face (5), and an edge face (6);

b. selecting a top plate (7) having an upper face (8), a lower face (9), and an edge face (10);

c. selecting an elongated stud (11) having sides (12) and an edge face (13) therebetween and having an upper end (14) in abutting registration with said lower face (9) of said top plate (7) and a lower end (15) in abutting registration with said upper face (4) of said base plate (3);

d. selecting a first stud to plate tie connector (16) having:

i. an edge member (17); and ii. a face member (18) connected to said edge member (17) and projecting at a right angle thereto engaging said lower face (5) of said base plate (3); and e. selecting a second stud to plate tie connector (20) identical to said first stud to plate tie connector (16) having:

i. an edge member (21);

ii. a face member (22) connected to said edge member (21) and projecting at a right angle thereto engaging said upper face (8) of said top plate (7); and f. placing said edge member (17) of said first stud to plate tie connector (16) against said edge face (13) of said stud (11) and said edge face (6) of said base plate (3);

g. placing said face member (18) of said first stud to plate tie connector (16) against said lower face (5) of said base plate (3);

h. driving at least one of a plurality of fasteners (19) through said edge member (17) of said first stud to plate tie connector (16) into said edge face (13) of said stud (11) and driving at least one of said plurality of fasteners (19) through said edge member (17) into said edge face (6) of said base plate (3);

i. placing said edge member (21) of said second stud to plate tie connector (20) against said edge face (13) of said stud (11) and said edge face (10) of said top plate (7);

j. placing said face member (22) of said second stud to plate tie connector (20) against said upper face (8) of said top plate (7); and k. driving at least one of a plurality of fasteners (19) through said edge member (21) of said second stud to plate tie connector (20) into said edge face (13) of said stud (11) and driving at least one of said plurality of fasteners (19) through said edge member (21) into said edge face (10) of said top plate (7); wherein l. said stud to plate tie connection 1 includes an underlying structural member and said base plate (3) rests on an underlying structural member (33); and m. said face member (18) of said first stud to plate tie connector (16) is driven between said base plate (3) and said underlying structural member (33).

10. The method of claim 9 wherein:

a. said underlying structural member (33) is a subfloor member.

11. The method of claim 9 wherein:

a. said underlying structural member (33) is a cementitious member.

12. The method of claim 11 wherein:

a. said cementitious member is a concrete foundation.

* * * * *